US011338293B2

(12) United States Patent
Ren et al.

(10) Patent No.: US 11,338,293 B2
(45) Date of Patent: May 24, 2022

(54) MICROFLUIDIC DEVICE, DROPLET IDENTIFICATION METHOD AND DROPLET CONTROL METHOD

(71) Applicants: Beijing BOE Display Technology Co., Ltd., Beijing (CN); BOE Technology Group Co., Ltd., Beijing (CN)

(72) Inventors: Jinyu Ren, Beijing (CN); Guojing Ma, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 180 days.

(21) Appl. No.: 16/767,681

(22) PCT Filed: Nov. 19, 2019

(86) PCT No.: PCT/CN2019/119438
§ 371 (c)(1),
(2) Date: May 28, 2020

(87) PCT Pub. No.: WO2020/140638
PCT Pub. Date: Jul. 9, 2020

(65) Prior Publication Data

US 2021/0107006 A1 Apr. 15, 2021

(30) Foreign Application Priority Data

Jan. 4, 2019 (CN) ..... 201910008979.X

(51) Int. Cl.
*B01L 3/00* (2006.01)

(52) U.S. Cl.
CPC . *B01L 3/502784* (2013.01); *B01L 2300/0887* (2013.01); *B01L 2300/161* (2013.01); *B01L 2400/0415* (2013.01)

(58) Field of Classification Search
CPC ..... B01L 2200/0626; B01L 2300/0887; B01L 2300/161; B01L 2300/165;
(Continued)

(56) References Cited

U.S. PATENT DOCUMENTS 10,374,115 B2 8/2019 Cao et al.
10,486,156 B2 11/2019 Campbell et al.
(Continued)

FOREIGN PATENT DOCUMENTS

CN 107497509 A 12/2017
CN 107527595 A 12/2017
(Continued)

OTHER PUBLICATIONS

Translation of JP 201851685 (Year: 2018).*
(Continued)

*Primary Examiner* — Jennifer Wecker
*Assistant Examiner* — Jonathan Bortoli
(74) *Attorney, Agent, or Firm* — Westman, Champlin & Koehler, P.A.

(57) ABSTRACT

A microfluidic device includes a first substrate and a second substrate opposite to each other. A light-emitting layer, a first driving layer, and a first hydrophobic layer are on surface of the first substrate facing the second substrate; and first hydrophobic layer is disposed near second substrate; a photosensitive layer, a second driving layer and a second hydrophobic layer are on surface of the second substrate facing the first substrate; and second hydrophobic layer is disposed near first hydrophobic layer, and a gap for holding a droplet is between second hydrophobic layer and first hydrophobic layer; the first and second driving layers are configured to drive the droplet to move within the gap when applied with a driving voltage; the light-emitting layer is configured to emit light with a set wavelength toward the
(Continued)

gap; and the photosensitive layer is configured to generate an induced current according to received light.

12 Claims, 3 Drawing Sheets

(58) Field of Classification Search
CPC ..... B01L 2400/0415; B01L 3/502707; B01L 3/502715; B01L 3/502784; B01L 3/502792
See application file for complete search history.

(56) References Cited

U.S. PATENT DOCUMENTS

| | | | | |
|---|---|---|---|---|
| 2016/0158748 | A1* | 6/2016 | Wu | B01L 3/50273 422/504 |
| 2017/0072397 | A1 | 3/2017 | Campbell et al. | |
| 2019/0097076 | A1 | 3/2019 | Cao et al. | |
| 2019/0105655 | A1 | 4/2019 | Dong et al. | |
| 2019/0369007 | A1 | 12/2019 | Tan et al. | |
| 2020/0108387 | A1 | 4/2020 | Dong et al. | |

FOREIGN PATENT DOCUMENTS

| | | | | |
|---|---|---|---|---|
| CN | 107607475 A | * | 1/2018 | B01L 3/502792 |
| CN | 107607475 A | | 1/2018 | |
| CN | 108956467 A | | 12/2018 | |
| CN | 108993620 A | | 12/2018 | |
| CN | 109092379 A | | 12/2018 | |
| CN | 109603938 A | | 4/2019 | |
| JP | 201851685 | * | 5/2018 | |
| WO | 2015170268 A1 | | 11/2015 | |

OTHER PUBLICATIONS

Translation of CN-107607475-A (Year: 2018).*
First Office Action, including Search Report, for Chinese Patent Application No. 201910008979.X, dated Dec. 16, 2019, 21 pages.

* cited by examiner

MICROFLUIDIC DEVICE, DROPLET IDENTIFICATION METHOD AND DROPLET CONTROL METHOD

CROSS-REFERENCE TO RELATED APPLICATION

The application is a Section 371 National Stage Application of International Application No. PCT/CN2019/119438, filed on Nov. 19, 2019, entitled "Microfluidic Device, Droplet Identification Method And Droplet Control Method", which claims priority to Chinese Patent Application No. 201910008979.X, filed on Jan. 4, 2019, the disclosures of which are incorporated herein by reference in their entireties.

TECHNICAL FIELD

The present disclosure relates to the field of microfluidic technology, and particularly, to a microfluidic device, and a droplet identification method and a droplet control method.

BACKGROUND

Microfluidic system refers to a system that uses microchannels to process or manipulate tiny fluids, and is an emerging interdisciplinary discipline involving chemistry, fluid physics, microelectronics, new materials, biology, and biomedical engineering. Because of the features such as miniaturization and integration, the microfluidic system can realize a series of micro-machining and micro-operations that are difficult to complete by conventional methods. At present, microfluidic system is considered to have huge development potential and wide application prospects in biomedical research.

However, the structure of the existing microfluidic system determines that the existing identification method is single and has low accuracy, and when identifying droplets, the droplets need to be accurately quantified, and the requirements for detection operations are also relatively high.

SUMMARY

In an aspect, embodiments of the present disclosure provide a microfluidic device comprising a first substrate and a second substrate opposite to each other; wherein a light-emitting layer, a first driving layer, and a first hydrophobic layer are on a surface of the first substrate facing the second substrate; and the first hydrophobic layer is disposed near the second substrate;

a photosensitive layer, a second driving layer and a second hydrophobic layer are on a surface of the second substrate facing the first substrate; and the second hydrophobic layer is disposed near the first hydrophobic layer, and a gap for holding a droplet is between the second hydrophobic layer and the first hydrophobic layer;

the first driving layer and the second driving layer are configured to drive the droplet to move within the gap when applied with a driving voltage;

the light-emitting layer is configured to emit light with a set wavelength toward the gap; and the photosensitive layer is configured to generate an induced current according to the received light.

In some embodiments, the first driving layer comprises a first electrode layer including a plurality of separated first sub-electrodes and a first transistor layer including a plurality of first transistors, and the first transistors are connected in a one-to-one correspondence with the first sub-electrodes;

the second driving layer comprises a second electrode layer including a plurality of separated second sub-electrodes and a second transistor layer including a plurality of second transistors, and the second transistors are connected in a one-to-one correspondence with the second sub-electrodes; and the first sub-electrodes are aligned in a one-to-one correspondence with the second sub-electrodes.

In some embodiments, the light-emitting layer is located between the first electrode layer and the first transistor layer, and the first electrode layer is disposed near the first hydrophobic layer; the first transistors are connected in a one-to-one correspondence with the first sub-electrodes through via holes in the light-emitting layer; and the photosensitive layer is located between the second electrode layer and the second transistor layer, and the second electrode layer is disposed near the second hydrophobic layer; the second transistors are connected in a one-to-one correspondence with the second sub-electrodes through via holes in the photosensitive layer.

In some embodiments, the light-emitting layer comprises an infrared light source layer and a collimating device layer disposed in stack; wherein the collimating device layer is disposed near the first hydrophobic layer.

In some embodiments, material of the infrared light source layer includes at least one of aluminum gallium arsenide, gallium arsenide, gallium arsenide phosphide, or indium gallium phosphide.

In some embodiments, the device further comprises a controller; the controller is configured to control the driving voltage on the first driving layer and the second driving layer so as to control a movement of the droplet in the gap between the first hydrophobic layer and the second hydrophobic layer. The controller may be further configured to: control the light-emitting layer to emit infrared light with a set wavelength; and identify the droplet and determine a position of the droplet according to the induced current generated by the photosensitive layer. The controller may be further configured to identify the droplet and determine a position of the droplet according to the induced current generated by the photosensitive layer.

In another aspect, embodiments of the present disclosure provide a droplet identification method, which is applied to the microfluidic device according to the abovementioned embodiments, and the method comprises:

injecting the droplet into the gap between the first hydrophobic layer and the second hydrophobic layer;

controlling the light-emitting layer to emit infrared light with a set wavelength; wherein a part of the infrared light is absorbed by the droplet, and another part of the infrared light penetrates the droplet and is incident on the photosensitive layer;

acquiring the induced current generated by the photosensitive layer after the photosensitive layer receives the infrared light that penetrates the droplet; and determining information of the droplet according to the induced current.

In some embodiments, the information of the droplet includes at least one of composition of the droplet and position of the droplet.

In yet another aspect, embodiments of the present disclosure provide a droplet control method, which is applied to the microfluidic device according to the abovementioned embodiments, and the method comprises:

applying the driving voltage to the first driving layer and the second driving layer so as to drive the droplet to move in the gap between the first hydrophobic layer and the second hydrophobic layer;

controlling the light-emitting layer to emit infrared light with a set wavelength;

acquiring the induced current generated by the photosensitive layer after the photosensitive layer receives the infrared light that penetrates the droplet; and adjusting the driving voltage according to the induced current so as to control a movement track of the droplet.

In some embodiments, adjusting the driving voltage according to the induced current so as to control a movement track of the droplet, further comprises:

determining current position of the droplet according to the induced current; and adjusting the driving voltage of the first driving layer and the second driving layer at the current position according to the current position of the droplet and preset track of the droplet, so as to control the droplet to move along the preset track.

DETAILED DESCRIPTION OF THE EMBODIMENTS

In order to make the above objects, features, and advantages of the present disclosure more obvious and understandable, the present disclosure will be described in further detail below with reference to the drawings and specific embodiments.

Figure 1:
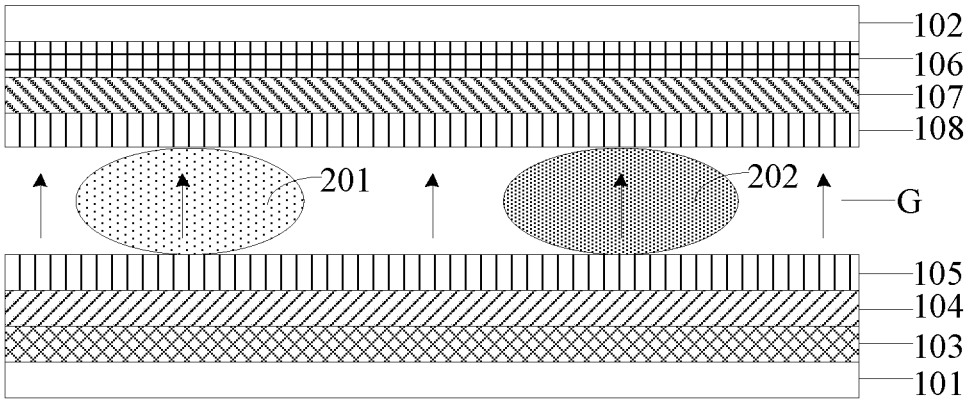
FIG. 1 shows a schematic structural diagram of a microfluidic device according to an embodiment of the present disclosure.

Referring to FIG. 1, a schematic structural diagram of a microfluidic device according to an embodiment of the present disclosure is shown. As shown in FIG. 1, a microfluidic device comprises a first substrate 101 and a second substrate 102 opposite to each other. A light-emitting layer 103, a first driving layer 104, and a first hydrophobic layer 105 are on a surface of the first substrate 101 facing the second substrate 102; the first hydrophobic layer 105 is disposed near the second substrate 102.

A photosensitive layer 106, a second driving layer 107 and a second hydrophobic layer 108 are on a surface of the second substrate 102 facing the first substrate 101; the second hydrophobic layer 108 is disposed near the first hydrophobic layer 105, and a gap G for holding a droplet is between the second hydrophobic layer 108 and the first hydrophobic layer 105.

The first driving layer 104 and the second driving layer 107 are applied with a driving voltage to drive the droplet to move within the gap G.

The light-emitting layer 103 is configured to emit light with a set wavelength toward the gap; and the photosensitive layer 106 is configured to generate an induced current according to the received light.

In this embodiment, the microfluidic device comprises the first substrate 101 and the second substrate 102, and the first substrate 101 and the second substrate 102 are opposite to each other. The light-emitting layer 103, the first driving layer 104, and the first hydrophobic layer 105 are on the surface of the first substrate 101 facing the second substrate 102. The photosensitive layer 106, the second driving layer 107 and the second hydrophobic layer 108 are on the surface of the second substrate 102 facing the first substrate 101. The first hydrophobic layer 105 is disposed near the second substrate 102, the second hydrophobic layer 108 is disposed near the first hydrophobic layer 105, and the gap G for holding a droplet is between the second hydrophobic layer 108 and the first hydrophobic layer 105. When a droplet is injected into the gap G between the first hydrophobic layer 105 and the second hydrophobic layer 108, a driving voltage is applied to the first driving layer 104 and the second driving layer 107 to drive the droplet to move in the gap G. Specifically, positions of the driving layer where no driving voltage is applied are hydrophobic, and positions of the driving layer where the driving voltage is applied are hydrophilic, and a voltage can be applied at different positions on the first driving layer 104 and the second driving layer 107 to bring the droplet closer to the positions where the driving voltage is applied, thereby driving the droplet to move. The first hydrophobic layer 105 and the second hydrophobic layer 108 may be Teflon materials, which are not limited in detail in the embodiments of the present disclosure, and can be set according to actual conditions.

The light-emitting layer 103 emits light with a set wavelength toward the gap G. For example, the light-emitting layer 103 emits light with a wavelength of about 9.45 μm toward the gap G. The photosensitive layer 106 receives the light emitted by the light-emitting layer 103, and generates an induced current according to the received light. For example, the photosensitive layer 106 generates an induced current I0 according to the light with the wavelength of about 9.45 μm. Since the droplet can absorb a part of the light emitted by the light-emitting layer 103, the light received by the photosensitive layer 106 at the position where the droplet is in is different from the light received at the position where no droplet is in, and the induced current generated at the position where the droplet is in is different from the induced current generated at the position where no droplet is in. For example, the induced current I1 is generated at the position where the droplet is in, and the induced current I0 is generated at the position where no droplet is in. According to the induced currents I0 and I1, the position of the droplet can be determined.

Further, the droplets of different compositions have different absorption rates for light emitted by the light-emitting layer 103. For example, the light-emitting layer 103 emits light with a wavelength of about 9.45 μm, the droplet 201 has a light absorption of 90%, and the droplet 202 does not absorb light. When the light-emitting layer 103 emits light with multiple wavelengths, droplets of different compositions absorb light with different wavelengths. For example, the light-emitting layer 103 emits two kinds of light with a wavelength of about 9.45 μm and about 3.42 μm, the droplet 201 absorbs light with the wavelength of about 9.45 μm, and the photosensitive layer 106 receives the light with the wavelength of about 3.42 μm that penetrates the droplet 201, to generate the induced current I2; the droplet 202 absorbs the light with the wavelength of about 3.42 μm, and the photosensitive layer 106 receives the light with the wavelength of about 9.45 μm that penetrates the droplet 202, to generate the induced current I3. It can be seen that the induced currents I2 and I3 can reflect the wavelengths of light absorbed by the droplets 201 and 202, so that the compositions of the droplet 201 and the droplet 202 can be determined according to the induced currents I2 and I3. Moreover, the positions of the droplets 201 and 202 can be determined according to the acquired positions of the induced currents I2 and I3, and the driving voltage on the first driving layer 104 and second driving layer 107 can be adjusted to control the movement directions of the droplets 201 and 202 between the first hydrophobic layer 105 and the second hydrophobic layer 108, so as to transport the droplets 201 and 202 to different positions.

Figure 2:
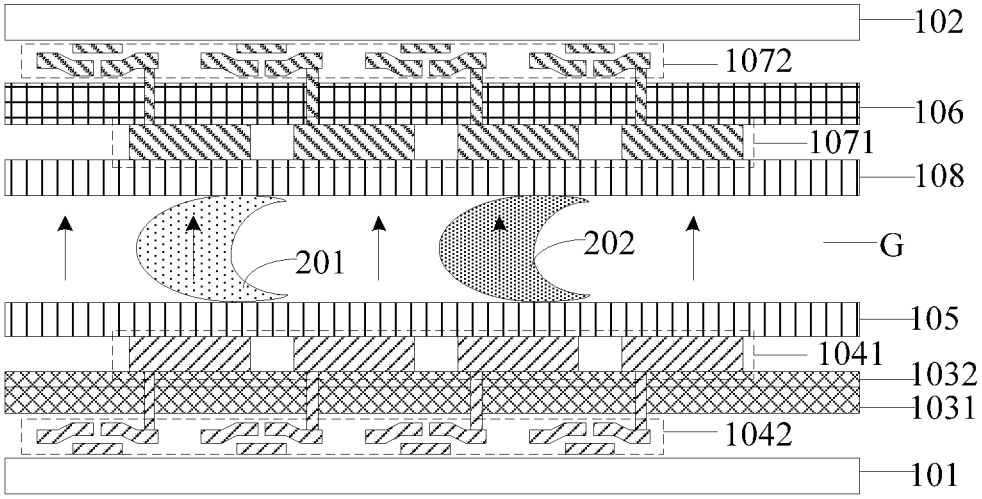
FIG. 2 shows a schematic structural diagram of a microfluidic device according to another embodiment of the present disclosure.

FIG. 2 shows a schematic structural diagram of a microfluidic device according to another embodiment of the present disclosure. For the sake of clarity, only the contents of the embodiment shown in FIG. 2 different from that of the embodiment shown in FIG. 1 are described below, and the same parts are no longer repeated. As shown in FIG. 2, the first driving layer 104 comprises a first electrode layer 1041 including a plurality of separated first sub-electrodes and a first transistor layer 1042 including a plurality of first transistors, and the first transistors are connected in a one-to-one correspondence with the first sub-electrodes.

The second driving layer 107 comprises a second electrode layer 1071 including a plurality of separated second sub-electrodes and a second transistor layer 1072 including a plurality of second transistors, and the second transistors are connected in a one-to-one correspondence with the second sub-electrodes.

The first sub-electrodes are aligned in a one-to-one correspondence with the second sub-electrodes.

In this embodiment, the first driving layer 104 comprises the first electrode layer 1041 and the first transistor layer 1042, the first electrode layer 1041 includes the plurality of first sub-electrodes separated from each other. The first transistor layer 1042 includes the plurality of first transistors, and the first transistors are connected in a one-to-one correspondence with the first sub-electrodes. The driving voltage on the respective first sub-electrodes can be controlled by the first transistors.

The second driving layer 107 comprises the second electrode layer 1071 and the second transistor layer 1072, the second electrode layer 1071 includes the plurality of second sub-electrodes separated from each other. The second transistor layer 1072 includes the plurality of second transistors, and the second transistors are connected in a one-to-one correspondence with the second sub-electrodes. The driving voltage on the respective second sub-electrodes can be controlled by the second transistors.

The first sub-electrodes are aligned in a one-to-one correspondence with the second sub-electrodes. Applying driving voltage on the first sub-electrodes and the second sub-electrodes can control the movement direction of the droplet and transport the droplet to the designated position. For example, there are two adjacent sub-electrodes, a driving voltage is applied to one sub-electrode, and no driving voltage is applied to the other sub-electrode. The sub-electrode is applied with no driving voltage, the droplet is hydrophobic, and the contact angle is greater than 90°. The sub-electrode is applied with the driving voltage, the droplet is hydrophilic, and the contact angle is less than 90°. That is, the droplet moves towards the direction of the sub-electrode to which the driving voltage is applied. By controlling the driving voltage on different first sub-electrodes and the corresponding second sub-electrodes, the movement direction of the droplet can be controlled. For example, in accordance with the induced currents I2 and I3, the droplets 201 and 202 are identified and the positions of the droplets 201 and 202 are determined. The driving voltage applied on the first sub-electrodes and the second sub-electrodes at the position where the droplet 201 is in is adjusted to control the movement direction of the droplet 201, and the droplet 201 is transported to a first position; the driving voltage applied on the first sub-electrodes and the second sub-electrodes at the position where the droplet 202 is in is adjusted to control the movement direction of the droplet 202, and the droplet 202 is transported to a second position.

In some embodiments, the light-emitting layer 103 is located between the first electrode layer 1041 and the first transistor layer 1042, and the first electrode layer 1041 is disposed near the first hydrophobic layer 105; the first transistors are connected in a one-to-one correspondence with the first sub-electrodes through via holes in the light-emitting layer 103.

The photosensitive layer 106 is located between the second electrode layer 1071 and the second transistor layer 1072, and the second electrode layer 1071 is disposed near the second hydrophobic layer 108; the second transistors are connected in a one-to-one correspondence with the second sub-electrodes through via holes in the photosensitive layer 106.

In this embodiment, in order to better control the droplets, the first electrode layer 1041 can be disposed at a position near the first hydrophobic layer 105, and the second electrode layer 1071 can be disposed at a position near the second hydrophobic layer 108. The light-emitting layer 103 is disposed between the first electrode layer 1041 and the first transistor layer 1042, and the photosensitive layer 106 is disposed between the second electrode layer 1071 and the second transistor layer 1072. Via holes are provided in the light-emitting layer 103, so that the first transistors and the first sub-electrodes can be connected in a one-to-one correspondence with each other through the via holes. Via holes are provided in the photosensitive layer 106, so that the second transistors and the second sub-electrodes can be connected in a one-to-one correspondence with each other through the via holes.

In some embodiments, the light-emitting layer 103 comprises an infrared light source layer 1031 and a collimating device layer 1032 disposed in stack; and the collimating device layer 1032 is disposed near the first hydrophobic layer 105.

In this embodiment, the light-emitting layer 103 may comprise the infrared light source layer 1031 and the collimating device layer 1032. The infrared light source layer 1031 emits infrared light, and the collimating device layer 1032 is disposed near the first hydrophobic layer 105, so that the infrared light emitted by the infrared light source layer 1031 is aligned to the gap G between the first hydrophobic layer 105 and the second hydrophobic layer 108.

In some embodiments, material of the infrared light source layer 1031 includes but is not limited to at least one of aluminum gallium arsenide, gallium arsenide, gallium arsenide phosphide, and indium gallium phosphide.

In this embodiment, the infrared light source layer 1031 may include at least one material of aluminum gallium arsenide, gallium arsenide, gallium arsenide phosphide, and indium gallium phosphide. The light-emitting layer 103 may emit infrared light of at least one wavelength according to the material of the infrared light source layer 1031. For example, if the infrared light source layer 1031 includes only one material of aluminum gallium arsenide, the light-emitting layer 103 can emit infrared light of one wavelength. If the infrared light source layer 1031 includes two materials of aluminum gallium arsenide and gallium arsenide, the light-emitting layer 103 can emit infrared light of two wavelengths. Also, the amount of light emission can correspond to the content of the material. For example, if the infrared light source layer 1031 includes 60% aluminum gallium arsenide and 40% gallium arsenide, the light-emitting layer 103 can emit 60% first infrared light and 40% second infrared light. This embodiment of the present disclosure does not limit this in detail, and can be set according to actual conditions.

In some embodiments, the device may further comprise a controller 109. The controller 109 is configured to control the driving voltage on the first driving layer 104 and the second driving layer 107 so as to control a movement of the droplet in the gap between the first hydrophobic layer 105 and the second hydrophobic layer 108; to control the light-emitting layer 103 to emit infrared light with a set wavelength; and to identify the droplet and determine a position of the droplet according to the induced current generated by the photosensitive layer 106.

In this embodiment, the microfluidic device includes the controller 109, and the controller 109 can be preset with a correspondence between driving voltage and contact angle, where the contact angle includes at least one of the first contact angle of the droplet contacting the first hydrophobic layer 105, and the second contact angle of the droplet contacting the second hydrophobic layer 108. The controller 109 can adjust the driving voltage on the first driving layer 104 and the second driving layer 107 according to the detected contact angle, thereby adjusting the contact angle of the droplet with the first hydrophobic layer 105 and the second hydrophobic layer 108, thereby controlling the movement direction of the droplet.

The controller 109 can also control light emission of the light-emitting layer 103. Since the infrared light source layer 1031 of the light-emitting layer 103 can include multiple materials, the light-emitting layer 103 can emit infrared light of at least one wavelength during light emission. For example, the light-emitting layer 103 emits two kinds of light with wavelengths of about 9.45 μm and about 3.42 μm, and the photosensitive layer 106 receives the light emitted by the light-emitting layer 103 and generates induced current according to the received light. Due to the difference in the position and composition of the droplets, the light received by the photosensitive layer 106 and the induced current generated by the photosensitive layer 106 are different. The controller 109 identifies the composition of the droplet in accordance with the induced current generated by the photosensitive layer 106, and can determine the position of the droplet.

In summary, in the embodiments of the present disclosure, the microfluidic device applies driving voltage on the first driving layer and the second driving layer to drive the droplets to move within the gap; the light-emitting layer is configured to emit light of a set wavelength toward the gap; and the photosensitive layer is configured to generate induced current in accordance with the received light. Because the compositions of the droplets are different, or the positions of the droplets are different, the light received by the photosensitive layer and the induced current generated by the photosensitive layer are also different. Therefore, the composition of the droplet and the position of the droplet and the like can be identified in accordance with the induced current. Moreover, adjusting the driving voltage on the first driving layer and the second driving layer can control the movement track of the droplet between the first hydrophobic layer and the second hydrophobic layer, so as to transport the droplet to different positions. With the embodiments of the present disclosure, the microfluidic device can realize multiple functions such as identifying multiple kinds of droplets and controlling the movement track of the droplets.

Figure 3:
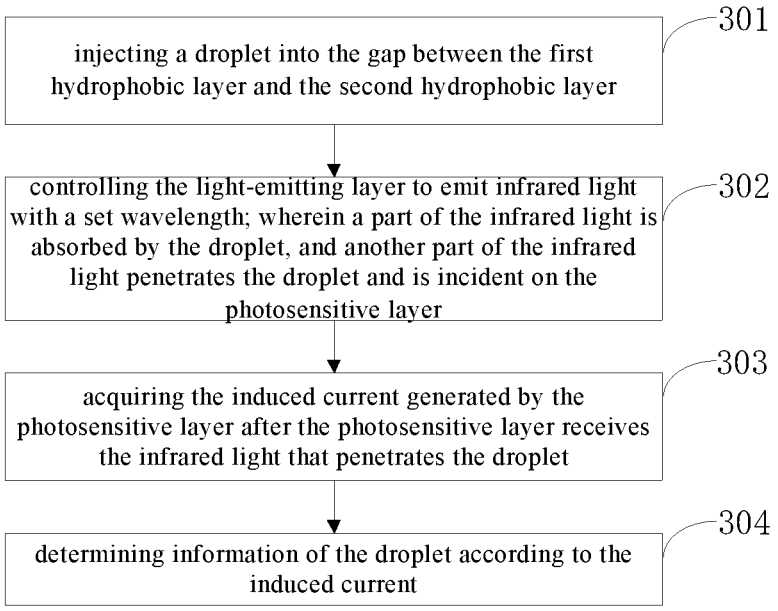
FIG. 3 shows a flowchart of steps of a droplet identification method according to an embodiment of the present disclosure.

Referring to FIG. 3, a flowchart of steps of a droplet identification method according to an embodiment of the present disclosure is shown. The droplet identification method is applied to the aforementioned microfluidic device, and comprises the following steps.

A step 301 is to inject a droplet into the gap G between the first hydrophobic layer 105 and the second hydrophobic layer 108.

In this embodiment, in the microfluidic device, the second hydrophobic layer 108 is disposed near the first hydrophobic layer 105, and has the gap G with the first hydrophobic layer 105. The droplet is injected into the gap G between the first hydrophobic layer 105 and the second hydrophobic layer 108. For example, the droplets 201 and 202 are injected into the gap G.

A step 302 is to control the light-emitting layer 103 to emit infrared light with a set wavelength; wherein a part of the infrared light is absorbed by the droplet, and another part of the infrared light penetrates the droplet and is incident on the photosensitive layer 106.

In this embodiment, because the light-emitting layer 103 is controlled to emit light and the light-emitting layer 103 may comprise multiple materials, the light-emitting layer 103 can emit infrared light with multiple set wavelengths. A part of the infrared light emitted by the light-emitting layer 103 is absorbed by the droplet, and another part of the infrared light penetrates the droplet and is incident on the photosensitive layer 106. For example, the light-emitting layer 103 emits two kinds of light with wavelengths of about 9.45 μm and about 3.42 μm, the light with the wavelength of about 9.45 μm is absorbed by the droplet 201, and the light with the wavelength of about 3.42 μm penetrates the droplet 201 and is incident on the photosensitive layer 106, while the light with the wavelength of about 3.42 μm is absorbed by the droplet 202, and the light with the wavelength of about 9.45 μm penetrates the droplet 202 and is incident on the photosensitive layer 106.

A step 303 is to acquire the induced current generated by the photosensitive layer after the photosensitive layer 106 receives the infrared light that penetrates the droplet.

In this embodiment, at the position where the droplet is in, the photosensitive layer 106 receives infrared light that penetrates the droplet, and generates induced current according to the received infrared light. For example, at the position where the droplet 201 is in, the photosensitive layer 106 receives light with a wavelength of 3.42 μm, and generates induced current I2; while at the position where the droplet 202 is in, the photosensitive layer 106 receives light with a wavelength of 9.45 μm, and generates induced current I3. At the position where no droplet is in, the photosensitive layer 106 receives the infrared light of the two wavelengths emitted by the light-emitting layer 103, generates induced current I4. The induced currents I2, I3 and I4 generated by the photosensitive layer 106 are acquired.

A step 304 is to determine information of the droplet according to the induced current.

In this embodiment, the information of the droplet includes at least one of the composition of the droplet and the position of the droplet. Specifically, the composition of the droplet can be determined in accordance with the induced current. For example, in accordance with the induced currents I2 and I3, it can be identified that the droplet 201 absorbs light with a wavelength of about 9.45 μm, and the droplet 202 absorbs light with a wavelength of about 3.42 μm, thereby determining the compositions of the droplets 201 and 202. The position of the droplet can be determined in accordance with the induced current. For example, the positions of the droplets are determined according to the acquired positions of induced currents I2 and I3.

It can be seen that in the droplet identification method according to the embodiments of the present disclosure, the droplet is injected into the gap between the first hydrophobic layer and the second hydrophobic layer; the light-emitting layer is controlled to emit infrared light with a set wavelength; the induced current generated by the photosensitive layer after receiving the infrared light that penetrates the droplet is acquired; the information of the droplet is determined in accordance with the induced current. With the embodiments of the present disclosure, when identifying droplets, there is no need to accurately control the dropping amount of droplets, which simplifies the detection operation.

Figure 4:
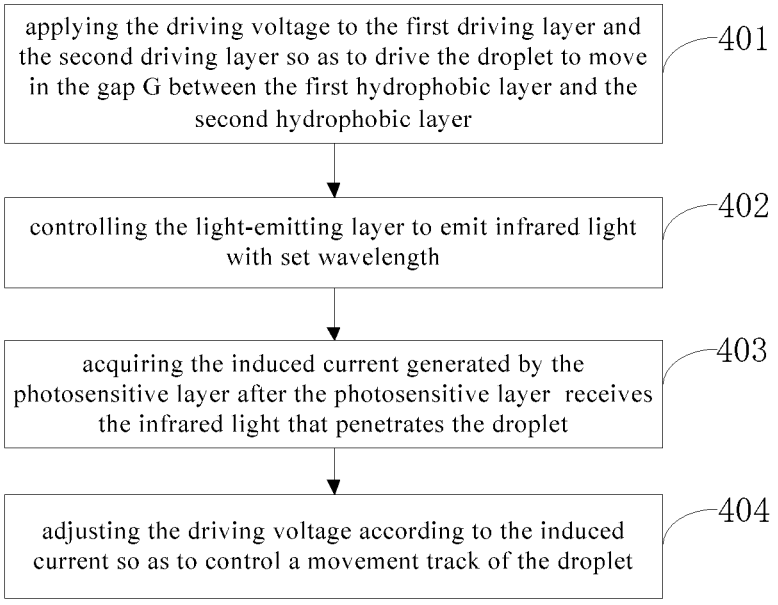
FIG. 4 shows a flowchart of steps of a droplet control method according to an embodiment of the present disclosure.

Referring to FIG. 4, embodiments of the present disclosure provide a flowchart of steps of a method of controlling a movement track of a droplet. The method is applied to the aforementioned microfluidic device, and comprises the following steps.

A step 401 is to apply the driving voltage to the first driving layer 104 and the second driving layer 107 so as to drive the droplet to move in the gap G between the first hydrophobic layer 105 and the second hydrophobic layer 108.

A step 402 is to control the light-emitting layer 103 to emit infrared light with set wavelength.

A step 403 is to acquire the induced current generated by the photosensitive layer 106 after the photosensitive layer 106 receives the infrared light that penetrates the droplet.

A step 404 is to adjust the driving voltage according to the induced current so as to control a movement track of the droplet.

Figure 5:
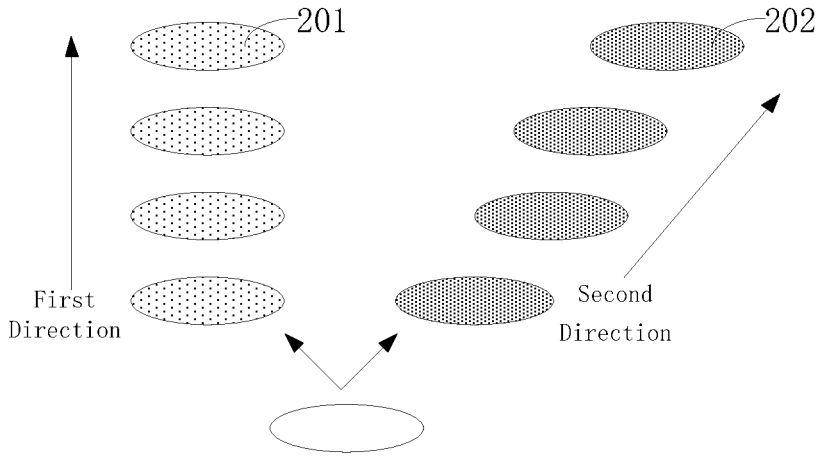
FIG. 5 shows a schematic diagram of a droplet movement track according to an embodiment of the present disclosure.
Figure 6:
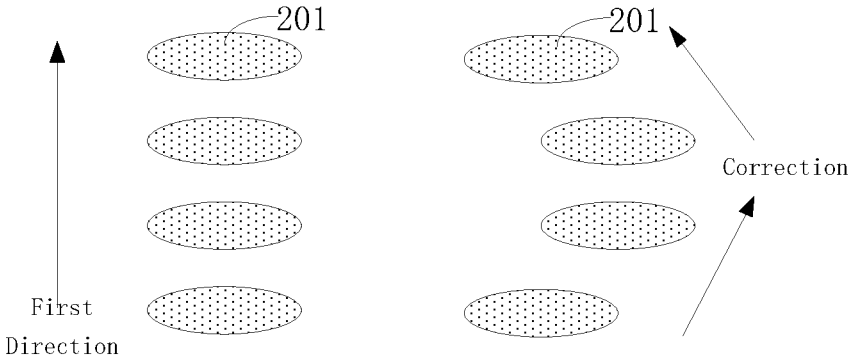
FIG. 6 shows a schematic diagram of a droplet movement track according to another embodiment of the present disclosure.

In this embodiment, droplets of different compositions are provided with different movement trackies. For example, referring to the schematic diagram of the movement track of the droplet shown in FIG. 5, a driving voltage is applied to the first driving layer 104 and the second driving layer 107 to move the droplet 201 in a first direction; and a driving voltage is applied to the first driving layer 104 and the second driving layer 107 to move the droplet 202 in a second direction. Referring to the schematic diagram of the movement track of the droplet shown in FIG. 6, the droplet 201 moves in the first direction, and once the droplet 201 deviates from the first direction, the movement direction of the droplet 201 can be corrected. Specifically, the current position of the droplet is determined in accordance with induced current. For example, the current position of the droplet 201 can be determined in accordance with induced current I2. In accordance with the current position of the droplet and the preset track of the droplet, the driving voltages of the first driving layer 104 and the second driving layer 107 at the current position are adjusted to control the movement of the droplet along the preset track. For example, comparing the position where the induced current I2 is detected with the position in the preset track, if the position where the induced current I2 is detected is inconsistent with the position in the preset track, indicating that the droplet 201 deviates from the direction, then the driving voltage on the first sub-electrodes and second sub-electrodes at the position where the droplet 201 is in is adjusted, so that the droplet 201 gradually approaches the position in the preset track. In other words, the droplet is controlled to move along the preset track.

It can be seen that in the method for controlling the movement track of droplets according to the embodiments of the present disclosure, a driving voltage is applied on the first driving layer and the second driving layer to drive the droplets to move in the gap between the first hydrophobic layer and the second hydrophobic layer; the light-emitting layer is controlled to emit infrared light with a set wavelength; the induced current generated by the photosensitive layer after receiving infrared light that penetrates the droplet is acquired; the driving voltage is adjusted in accordance with the induced current to control the movement track of the droplet. With the embodiments of the present disclosure, droplets of different compositions can be transported to different positions, which is simple and easy to operate.

The embodiments in this description are described in a progressive manner. Each of the embodiments focuses on the differences from other embodiments, and the same or similar parts between the embodiments may refer to each other.

Finally, it should also be noted that in this text, relational terms such as first and second are used only to distinguish one entity or operation from another entity or operation, and do not necessarily require or imply there is any such actual relationship or order between these entities or operations. Moreover, the terms "comprise", "include" or any other variant thereof are intended to cover non-exclusive inclusion, so that a process, method, commodity or device that includes a series of elements includes not only those elements, but also includes other elements that are not explicitly listed, or elements inherent to this process, method, commodity, or device. Without more restrictions, the elements defined by the phase "comprise/comprising a/an . . . " do not exclude the existence of other identical elements in the process, method, commodity, or device that includes the elements.

The above provides a detailed introduction to a microfluidic device, methods for droplet identification and for controlling movement track according to the present disclosure. Specific examples are used in this description to explain the principles and implementations of the present disclosure. This description to the aforementioned embodiments is used to help understand the method and its core idea of the present disclosure. Meanwhile, for those of ordinary skill in the art, according to the idea of the present disclosure, there will be changes in the specific implementations and application scope. In all, contents in this description should not be construed as limiting the present disclosure.

What is claimed is:

1. A microfluidic device comprising a first substrate and a second substrate opposite to each other; wherein a light-emitting layer, a first driving layer, and a first hydrophobic layer are on a surface of the first substrate facing the second substrate; and the first hydrophobic layer is disposed near the second substrate;

a photosensitive layer, a second driving layer and a second hydrophobic layer are on a surface of the second substrate facing the first substrate; and the second hydrophobic layer is disposed near the first hydrophobic layer, and a gap for holding a droplet is between the second hydrophobic layer and the first hydrophobic layer;

the first driving layer and the second driving layer are configured to drive the droplet to move within the gap when applied with a driving voltage;

the light-emitting layer is configured to emit light with a set wavelength toward the gap; and the photosensitive layer is configured to generate an induced current according to the received light.

2. The microfluidic device of claim 1, wherein the first driving layer comprises a first electrode layer including a plurality of separated first sub-electrodes and a first transistor layer including a plurality of first transistors, and the first transistors are connected in a one-to-one correspondence with the first sub-electrodes;

the second driving layer comprises a second electrode layer including a plurality of separated second sub-electrodes and a second transistor layer including a plurality of second transistors, and the second transistors are connected in a one-to-one correspondence with the second sub-electrodes; and the first sub-electrodes are aligned in a one-to-one correspondence with the second sub-electrodes.

3. The microfluidic device of claim 2, wherein the light-emitting layer is located between the first electrode layer and the first transistor layer, and the first electrode layer is disposed near the first hydrophobic layer; the first transistors are connected in a one-to-one correspondence with the first sub-electrodes through via holes in the light-emitting layer; and the photosensitive layer is located between the second electrode layer and the second transistor layer, and the second electrode layer is disposed near the second hydrophobic layer; the second transistors are connected in a one-to-one correspondence with the second sub-electrodes through via holes in the photosensitive layer.

4. The microfluidic device of claim 1, wherein the light-emitting layer comprises an infrared light source layer and a collimating device layer disposed in stack; wherein the collimating device layer is disposed near the first hydrophobic layer.

5. The microfluidic device of claim 4, wherein material of the infrared light source layer includes at least one of aluminum gallium arsenide, gallium arsenide, gallium arsenide phosphide, or indium gallium phosphide.

6. The microfluidic device of claim 1, further comprising a controller;

the controller is configured to control the driving voltage on the first driving layer and the second driving layer so as to control a movement of the droplet in the gap between the first hydrophobic layer and the second hydrophobic layer.

7. The microfluidic device of claim 6, wherein the controller is further configured to: control the light-emitting layer to emit infrared light with a set wavelength; and identify the droplet and determine a position of the droplet according to the induced current generated by the photosensitive layer.

8. The microfluidic device of claim 6, wherein the controller is further configured to identify the droplet and determine a position of the droplet according to the induced current generated by the photosensitive layer.

9. A droplet identification method, which is applied to the microfluidic device according to claim 1, the method comprising:

injecting the droplet into the gap between the first hydrophobic layer and the second hydrophobic layer;

controlling the light-emitting layer to emit infrared light with a set wavelength; wherein a part of the infrared light is absorbed by the droplet, and another part of the infrared light penetrates the droplet and is incident on the photosensitive layer;

acquiring the induced current generated by the photosensitive layer after the photosensitive layer receives the part of the infrared light that penetrates the droplet; and determining information of the droplet according to the induced current.

10. The method of claim 9, wherein the information of the droplet includes at least one of composition of the droplet and position of the droplet.

11. A droplet control method, which is applied to the microfluidic device according to claim 1, the method comprising:

applying the driving voltage to the first driving layer and the second driving layer so as to drive the droplet to move in the gap between the first hydrophobic layer and the second hydrophobic layer;

controlling the light-emitting layer to emit infrared light with a set wavelength;

acquiring the induced current generated by the photosensitive layer after the photosensitive layer receives the infrared light that penetrates the droplet; and adjusting the driving voltage according to the induced current so as to control a movement track of the droplet.

12. The method of claim 11, wherein adjusting the driving voltage according to the induced current so as to control a movement track of the droplet, further comprises:

determining current position of the droplet according to the induced current; and adjusting the driving voltage of the first driving layer and the second driving layer at the current position according to the current position of the droplet and preset track of the droplet, so as to control the droplet to move along the preset track.

* * * * *